US010108131B2

(12) United States Patent
Ueno

(10) Patent No.: US 10,108,131 B2
(45) Date of Patent: Oct. 23, 2018

(54) IMAGE FORMING APPARATUS

(71) Applicant: CANON KABUSHIKI KAISHA, Tokyo (JP)

(72) Inventor: Takashi Ueno, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/641,779

(22) Filed: Jul. 5, 2017

(65) Prior Publication Data

US 2018/0017929 A1 Jan. 18, 2018

(30) Foreign Application Priority Data

Jul. 13, 2016 (JP) ..... 2016-138697
Apr. 14, 2017 (JP) ..... 2017-080557

(51) Int. Cl.
*G03G 15/16* (2006.01)
*G03G 21/00* (2006.01)
*G03G 15/00* (2006.01)

(52) U.S. Cl.
CPC ..... *G03G 21/0011* (2013.01); *G03G 15/50* (2013.01)

(58) Field of Classification Search
CPC ..... G03G 21/0011; G03G 15/50
USPC ..... 399/71
See application file for complete search history.

(56) References Cited

U.S. PATENT DOCUMENTS 8,971,761 B2 3/2015 Yuasa

FOREIGN PATENT DOCUMENTS

| | | | | |
|---|---|---|---|---|
| EP | 2019344 A2 * | 1/2009 | ..... | G03G 15/161 |
| JP | 11-295948 A | 10/1999 | | |
| JP | 2008-039995 A | 2/2008 | | |
| JP | 2013-037355 A | 2/2013 | | |
| JP | 2014-126619 A | 7/2014 | | |

* cited by examiner

*Primary Examiner* — Susan Lee
(74) *Attorney, Agent, or Firm* — Fitzpatrick, Cella, Harper & Scinto

(57) ABSTRACT

An image forming apparatus includes a belt, an image bearing member, a developing portion, a belt transfer portion, a steering roller, a detection portion, a cleaning blade, a control portion, and an instruction input portion. In a case where the input has been performed through the instruction input portion, the control portion executes, before starting image formation for the first time after replacement of the belt, an adjustment mode including a series of processes in which a relationship between the position in the width direction and the amount of tilting of the steering roller is adjusted, and also performs a toner supplying operation of supplying toner by transferring a toner image for supplying toner onto the belt.

25 Claims, 13 Drawing Sheets

IMAGE FORMING APPARATUS

BACKGROUND OF THE INVENTION

Field of the Invention

The present invention relates to an image forming apparatus configured to form a toner image on a recording material by using, for example, an electrophotographic system.

Description of the Related Art

Conventionally, various image forming apparatuses that perform image formation by using an endless belt have been put to practical use. For example, an image forming apparatus employing an intermediate transfer system in which a toner image formed on a photosensitive drum is transferred onto an intermediate transfer belt through primary transfer and the toner image transferred onto the intermediate transfer belt through primary transfer is further transferred onto a recording material through secondary transfer has been proposed. The intermediate transfer belt will be hereinafter simply referred to as a belt. In the case of this apparatus, a cleaning blade is caused to rub the belt so as to remove transfer residual toner remaining on the belt, foreign matter that has exuded from the belt, and the like from the belt. The cleaning blade will be hereinafter simply referred to as a blade. The transfer residual toner, foreign matter, and the like will be hereinafter collectively referred to as attached matter. The belt and the blade are detachably provided, and thus can be replaced by a user as appropriate.

In an image forming apparatus including a belt, steering control of tilting a steering roller stretching the belt is performed when an image formation job is executed, that is, when image formation is performed. In the steering control, positioning of the belt in a width direction is dynamically performed by changing the tilt of the steering roller moment by moment on the basis of edge shape data and the position of the belt in the width direction detected by an edge sensor. The edge shape data is generated in advance and represents the position of the belt in the width direction in one rotation. According to this, the belt can rotate without being offset or meandering.

Conventionally, in Japanese Patent Laid-Open No. 11-295948, an image forming apparatus that performs a process of adjusting the positional relationship between the belt and the steering roller after generating the edge shape data of the belt, also called an edge profile, is proposed. The process of adjusting the positional relationship is also referred to as an adjustment mode. In this process, the edge shape data is generated on the basis of a result of detection by the edge sensor obtained when the belt is rotated without a toner image. However, in the case where the belt meanders while rotating at this time, the amount of meandering is included in the result of detection by the edge sensor, and precise edge shape data cannot be generated. To address this, in an invention disclosed in Japanese Patent Laid-Open No. 11-295948, in the process described above, the steering roller is tilted until the amount of meandering of the belt becomes equal to or below a predetermined level, and then the edge shape data is generated on the basis of the result of detection by the edge sensor. The process described above is performed every time the belt is replaced in order to generate edge shape data corresponding to the belt. For this operation, the image forming apparatus is configured such that a user can instruct execution of the process described above by operating a button or the like after replacing the belt.

At a time point immediately after replacement of the belt, hardly any toner is present in an abutting portion at which the blade rubs the belt unlike before the replacement. This state will be referred to as a toner lack state. In the case where the belt is rotated without a toner image in spite of being in the toner lack state, attached matter on the belt is likely to be scraped off by the blade. The scraped attached matter may be cooled and hardened as a result of the belt being stopped, and thus may adhere to the belt. To distinguish the attached matter adhering to the belt from the attached matter before being cooled and hardened, the attached matter adhering to the belt will be referred to as adhering matter. It is difficult to remove the adhering matter on the belt with the blade, and, if the adhering matter remains on the belt, the adhering matter may cause image defects such as stripe density irregularity or may damage the blade.

SUMMARY OF THE INVENTION

According to a first aspect of the present invention, an image forming apparatus includes a belt formed in an endless shape, detachably provided, and configured to rotate, an image bearing member that is rotatable and configured to bear an electrostatic latent image formed thereon, a developing portion configured to develop the electrostatic latent image formed on the image bearing member as a toner image with developer comprising toner, a belt transfer portion configured to transfer the toner image formed on the image bearing member onto the belt, a steering roller configured to stretch the endless belt and be tilted to move the belt in a width direction of the belt intersecting with a rotation direction of the belt, a detection portion configured to detect a position of an edge portion of the belt in the width direction, a cleaning blade configured to rub the belt at a rubbing position, a control portion configured to control, in a period of image formation, an amount of tilting of the steering roller on a basis of the position in the width direction detected by the detection portion, and an instruction input portion through which input related to replacement of the belt is performed by an operator. In a case where the input has been performed through the instruction input portion, the control portion executes, before starting image formation for the first time after replacement of the belt, an adjustment mode including a series of processes in which a relationship between the position in the width direction and the amount of tilting of the steering roller is adjusted by tilting the steering roller while rotating the belt, and also performs a toner supplying operation of supplying toner to the rubbing position by transferring a toner image for supplying toner onto the belt and rotating the belt in at least one period of before, during, and after execution of the adjustment mode.

According to a second aspect of the present invention, an image forming apparatus includes a belt formed in an endless shape, detachably provided, and configured to rotate, an image bearing member that is rotatable and configured to bear an electrostatic latent image formed thereon, a developing portion configured to develop the electrostatic latent image formed on the image bearing member as a toner image with developer comprising toner, a belt transfer portion configured to transfer the toner image formed on the image bearing member onto the belt, a steering roller configured to stretch the endless belt and tilt to move the belt in a width direction of the belt intersecting with a rotation direction of the belt, a detection portion configured to detect a position of an edge portion of the belt in the width direction, a cleaning blade configured to rub the belt at a rubbing position, a control portion configured to control, in a period of image formation, an amount of tilting of the steering roller on a basis of the position in the width direction detected by the detection portion, and a replacement detection portion configured to detect information related to replacement of the belt. In a case where the information related to replacement of the belt has been detected by the replacement detection portion, the control portion executes, before starting image formation for the first time after replacement of the belt, an adjustment mode including a series of processes in which a relationship between the position in the width direction and the amount of tilting of the steering roller is adjusted by tilting the steering roller while rotating the belt, and also performs a toner supplying operation of supplying toner to the rubbing position by transferring a toner image for supplying toner onto the belt and rotating the belt in at least one period of before, during, and after execution of the adjustment mode.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Image Forming Apparatus

Figure 1:
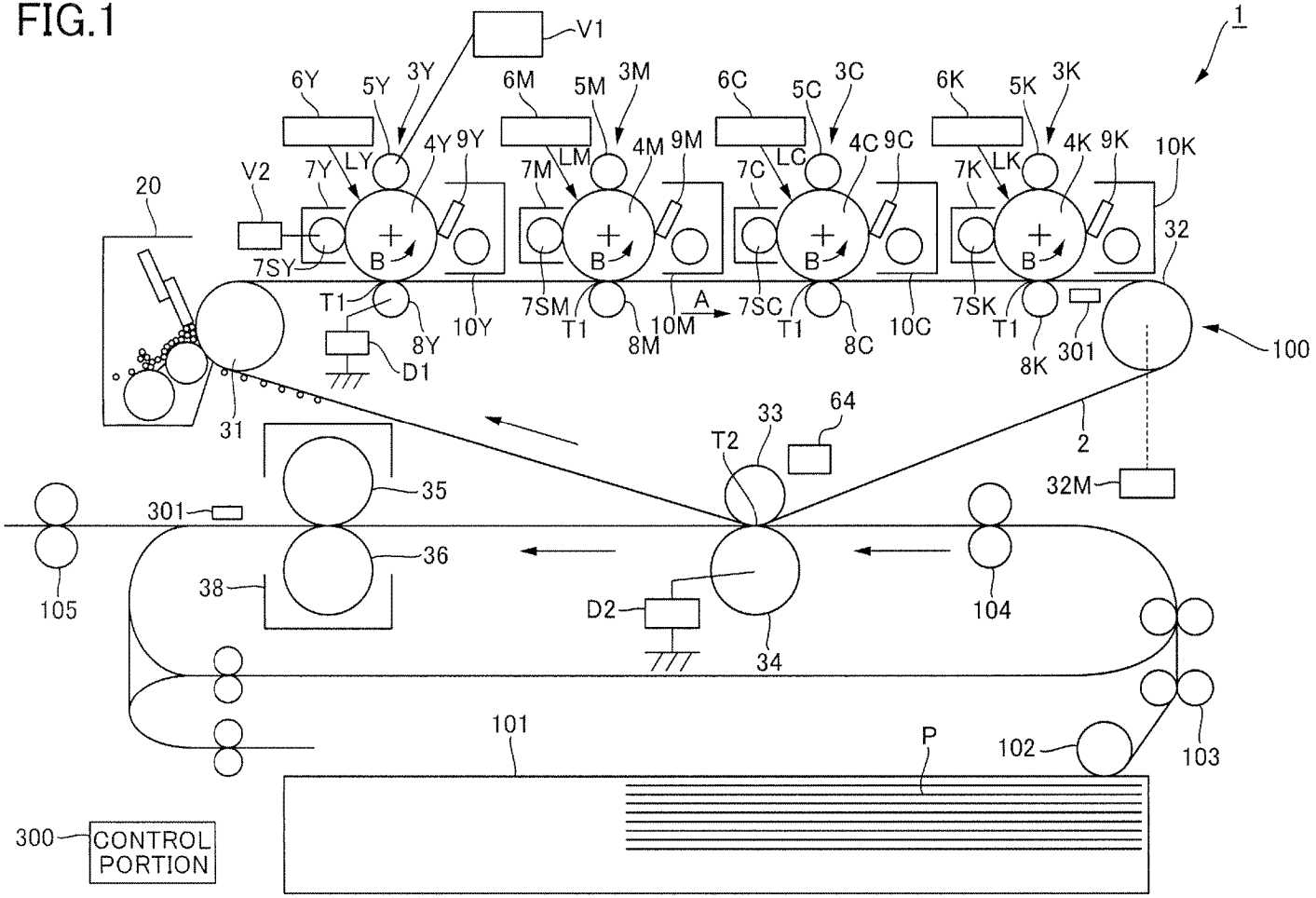
FIG. 1 is a schematic diagram illustrating a configuration of an image forming apparatus according to exemplary embodiments.

Exemplary embodiments will be described with reference to drawings. First, an image forming apparatus according to the exemplary embodiments will be described with reference to FIG. 1. An image forming apparatus 1 illustrated in FIG. 1 is a full-color printer employing an intermediate transfer system of a tandem type, in which image forming portions 3Y, 3M, 3C, and 3K, respectively corresponding to yellow, magenta, cyan and black, are arranged along an intermediate transfer belt 2. The intermediate transfer belt 2 will be hereinafter simply referred to as a belt 2. To be noted, a charging power source V1, a developing power source V2, and a primary transfer high-voltage power source D1 are only illustrated for the image forming portion 3Y in FIG. 1 for convenience of illustration.

In the image forming portion 3Y, a yellow toner image is formed on a photosensitive drum 4Y and is then transferred onto the belt 2 through primary transfer. In the image forming portion 3M, a magenta toner image is formed on a photosensitive drum 4M and is then transferred onto the belt 2 so as to be superimposed on the yellow toner image. In the image forming portions 3C and 3K, a cyan toner image and a black toner image are respectively formed on photosensitive drums 4C and 4K, and are then sequentially transferred onto the belt 2 so as to be superimposed on the yellow and magenta toner images.

The image forming portions 3Y, 3M, 3C, and 3K serving as toner supplying portions are configured almost in the same manner except that the color of used toner is different between developing units 7Y, 7M, 7C, and 7K, and are all capable of supplying toner to the belt 2. In the description below, the image forming portion 3Y will be described in detail. The description for the image forming portion 3Y can be also applied to the image forming portions 3M, 3C, and 3K by replacing the letter Y in the end of reference signs with M, C, and K.

In the image forming portion 3Y, a charging roller 5Y, an exposing unit 6Y, the developing unit 7Y, a primary transfer roller 8Y, and a drum cleaning unit 10Y are disposed so as to surround the photosensitive drum 4Y. The photosensitive drum 4Y is a drum-shaped electrophotographic photoconductor rotatably supported by an apparatus body, and is rotated counterclockwise, that is, in an arrow B direction, in FIG. 1 at a predetermined process speed by a photosensitive drum driving motor that is not illustrated. As will be described in detail later with reference to FIG. 2, the photosensitive drum 4Y is formed by forming a photosensitive layer on an outer peripheral surface of an aluminum cylinder.

The charging roller 5Y is subjected to a direct current voltage serving as a charging voltage applied thereto from the charging power source V1 serving as a charging voltage application portion, and thereby uniformly charges the surface of the photosensitive drum 4Y to a dark potential of a negative polarity. The exposing unit 6Y scans, by using a rotatable mirror, the charged surface of the photosensitive drum 4Y with a laser beam modulated on the basis of scanning line image data in which decomposed color images of respective colors are loaded, and thereby draws an electrostatic latent image on the surface of the photosensitive drum 4Y. The exposing unit 6Y may be an analog exposing unit configured to perform focusing projection exposure of a document image or a digital exposing unit such as a laser scanner or a light emitting diode array: LED array.

The developing unit 7Y uses two-component developer including toner and carrier, and supplies toner to the photosensitive drum 4Y to develop the electrostatic latent image as a toner image. The two-component developer will be hereinafter simply referred to as developer. The developing unit 7Y charges the toner to a negative polarity and the carrier to a positive polarity by agitating and conveying the developer. In the developing unit 7Y, a developing sleeve 7SY is disposed so as to oppose the surface of the photosensitive drum 4Y with a minute gap therebetween, and is rotated in a direction opposite to the rotation direction of the photosensitive drum 4Y. The charged developer is born by the developing sleeve 7SY and is conveyed to a portion at which the developing sleeve 7SY opposes the photosensitive drum 4Y. Then, a developing voltage serving as a developing bias is applied to the developing sleeve 7SY serving as a developer bearing member from the developing power source V2 serving as a developing voltage application portion. The developing voltage is generated by superposing an alternating current voltage on a direct current voltage. Thus, nonmagnetic toner charged to the negative polarity is transferred onto an exposed portion of the photosensitive drum 4Y that relatively has a positive polarity, and the electrostatic latent image is developed in a reversal manner.

The primary transfer roller 8Y serving as a belt transfer portion presses the belt 2 and thereby forms a primary transfer portion T1 serving as a primary transfer nip portion between the photosensitive drum 4Y and the belt 2. The primary transfer roller 8Y is disposed so as to be capable of being in contact with and separated from the photosensitive drum 4Y with the belt 2 interposed therebetween. The primary transfer roller 8Y is connected to the primary transfer high-voltage power source D1 serving as a first power source. The primary transfer high-voltage power source D1 applies a direct current voltage of a positive polarity serving as a primary transfer bias to the primary transfer roller 8Y, and the toner image of a negative polarity on the photosensitive drum 4Y serving as an image bearing member is thereby transferred onto the belt 2 through primary transfer. The drum cleaning unit 10Y collects toner remaining on the photosensitive drum 4Y after passing through the primary transfer portion T1 by, for example, bringing a cleaning blade 9Y formed of polyurethane into contact with the photosensitive drum 4Y.

The belt 2 is an intermediate transfer body that is capable of rotating while being in contact with the photosensitive drum 4Y, is stretched over a tension roller 31, a driving roller 32, and a secondary transfer inner roller 33 to be supported by these rollers, and rotates in a predetermined direction, that is, an arrow A direction in FIG. 1, by being driven by the driving roller 32. The tension roller 31, the driving roller 32, and the secondary transfer inner roller 33 stretch the belt 2 with a constant tension. The driving roller 32 is driven by an intermediate transfer belt driving motor 32M. The driving roller 32 is formed by coating the surface of a metal roller serving as a body portion with a rubber layer having a thickness of several millimeters such that slip on the belt 2 is prevented and a driving force is efficiently transmitted to the belt 2. The belt 2 is detachably provided, and a user can replace the belt 2 as appropriate.

The belt 2 is, for example, a resin belt formed to have an endless shape by using a resin material of a single layer structure such as polyimide or polycarbonate. Alternatively, as the belt 2, a coated belt formed by forming plural layers on a base material of these resin materials may be also used. As a material for a surface layer, a simple of melamine resin or urethane resin, mixture of these resins, a composite material of these resins, and so forth may be used.

The toner images of four colors transferred onto the belt 2 through primary transfer are conveyed to a secondary transfer portion T2 serving as a secondary transfer nip portion, and are collectively transferred onto a recording material P through secondary transfer. Examples of the recording material P include sheet materials such as paper sheets and overhead projector sheets: OHP sheets. The recording material P is taken out of a recording material cassette 101 by a pickup roller 102 and is sent out to registration rollers 104. In the case where plural recording materials P are taken out of the recording material cassette 101, one recording material P is separated from the plural recording materials P by separation rollers 103. The registration rollers 104 send out the recording material P to the secondary transfer portion T2 at a timing matching a timing of conveyance of the toner images formed on the belt 2. The toner images of four colors are transferred onto the recording material P through secondary transfer. Then, the recording material P is sent into the fixing unit 38 serving as a heating portion, and is subjected to heat and pressure applied by a heating roller 35 and a pressurizing roller 36. As a result of this, the toner image on the recording material P is heated and is thus fixed to the recording material P. The recording material P bearing the toner image fixed thereto is directly discharged to the outside of the apparatus through discharge rollers 105.

Secondary Transfer Portion

The secondary transfer portion T2 is formed by pressing a secondary transfer outer roller 34 against the secondary transfer inner roller 33 with the belt 2 interposed therebetween. The secondary transfer outer roller 34 serving as a recording material transfer portion is connected to a secondary transfer high-voltage power source D2. The secondary transfer high-voltage power source D2 serving as a second power source applies a direct current voltage of a positive polarity, which is opposite to the polarity of the toner, serving as a secondary transfer bias, to the secondary transfer outer roller 34, and thus the toner images transferred onto the belt 2 through primary transfer are collectively transferred, through secondary transfer, onto the recording material P conveyed to the secondary transfer portion T2. Transfer residual toner remaining attached to the belt 2 after secondary transfer is collected from the belt 2 by a belt cleaning unit 20. The belt cleaning unit 20 will be described later with reference to FIG. 3. The secondary transfer outer roller 34 is provided so as to be capable of being in contact with and separated from the secondary transfer inner roller 33 with the belt 2 interposed therebetween.

Two-Component Developer

As described above, in the developing unit 7Y, two-component developer including nonmagnetic toner that is negatively chargeable and magnetic carrier that is positively chargeable is used. In the two-component developer used in the present exemplary embodiment, weight ratio of the toner and the carrier is 9:91, that is, the density of toner is 9%. In addition, the weight average diameter of the toner is 5.7 μm.

The toner is constituted by binder resin, colorant, a charge control agent, and so forth. The binder resin will be also referred to as binder. Styrene acrylic resin is used as an exemplary binder resin. As a matter of course, the binder resin is not limited to this, and resins such as styrene-based resin, polyester-based resin, and polyethylene may be used as the binder resin. As the colorant, one type of colorant such as carbon black, dye, and pigment may be used alone, or plural kinds of colorants may be used in combination. As the charge control agent, a charge control agent containing a charging control agent for enhancement may be used as necessary. Any charging control agent may be used as long as the charging control agent includes nigrosine-based dye, triphenylmethane-based dye, or the like.

In addition, the toner contains wax. The wax is contained in the toner in order to improve, for example, releasability of the recording material P from the fixing unit 38 and fixability of the toner to the recording material P. Examples of the wax include paraffin wax, carnauba wax, and polyolefin. The wax is dispersed in the binder resin via kneading. In the present exemplary embodiment, toner produced by crushing, by a mechanical crusher, a resin in which binder resin, colorant, a charge control agent, and wax are dispersed via kneading is used.

Further, an external additive is added to the toner. Examples of the external additive include hydrophobized amorphous silica and inorganic oxide fine particles of titanium oxide, titanium compounds, and so forth. The fluidity of the toner as powder and the amount of charge of the toner is adjusted by adding these fine particles to the toner. The particle diameter of the external additive is preferably 1 nm to 100 nm. In the exemplary embodiments, titanium oxide particles having an average particle diameter of 50 nm are added by 0.5 wt. % and amorphous silica particles having average particle diameters of 2 nm and 100 nm are respectively added by 0.5 wt. % and 1.0 wt. %.

Ferrite particles coated by silicone resin are used as an exemplary carrier. In the exemplary embodiments, a carrier having a saturation magnetization of 24 $Am^2/kg$ in a magnetic field of 240 kA/m, a resistivity of $1\times10^7$ to $1\times10^8$ Ω·cm in an electric field of 3,000 V/cm, and a weight average particle diameter of 50 μm is used.

Photosensitive Drum

Figure 2:
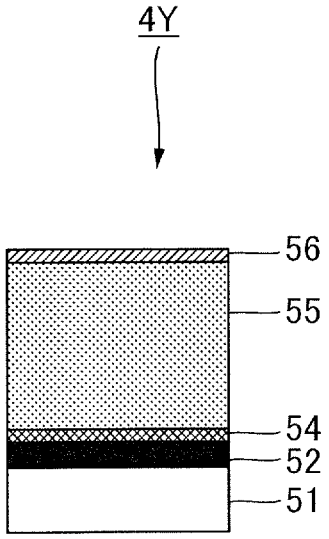
FIG. 2 is a section view of a photosensitive drum illustrating a structure thereof.

A structure of the photosensitive drum 4Y will be described with reference to FIG. 2. As illustrated in FIG. 2, in the photosensitive drum 4Y serving as an image bearing member, an undercoat layer 52, an organic photoconductor photosensitive layer: OPC photosensitive layer including layers 54 and 55, and a surface protecting layer 56 are formed on a conductive base body 51 in this order from the conductive base body 51. For example, an aluminum cylinder is used as the conductive base body 51. The undercoat layer 52 covers the conductive base body 51 for improvement of adhesion and applicability of the OPC photosensitive layer, protection of the conductive base body 51, coating of a defected portion of the conductive base body 51, improvement of charge injection from the conductive base body 51, protection of the OPC photosensitive layer from electrical breakdown, and so forth.

The OPC photosensitive layer includes a charge generation layer 54 and a charge transport layer 55 formed in this order. The charge generation layer 54 contains a charge generating substance, and the charge transport layer 55 contains a charge transporting substance. The surface protecting layer 56 is formed on the OPC photosensitive layer. The surface of the photosensitive drum 4Y, that is, one side of the surface protecting layer 56 is polished by a polishing tape such as lapping paper or via buffing such that a ten-point average roughness Rz defined in JIS B0601-1982 is in the range of 0.2 to 2 μm.

Belt Cleaning Unit

As has been described above, the image forming apparatus 1 includes the belt cleaning unit 20 to remove transfer residual toner and the like remaining on the belt 2 after passing through the secondary transfer portion T2. As illustrated in FIG. 1, the belt cleaning unit 20 is disposed upstream of the photosensitive drum 4Y in a rotation direction of the belt 2 indicated by the arrow A in FIG. 1. The belt cleaning unit 20 will be described with reference to FIG. 3.

Figure 3:
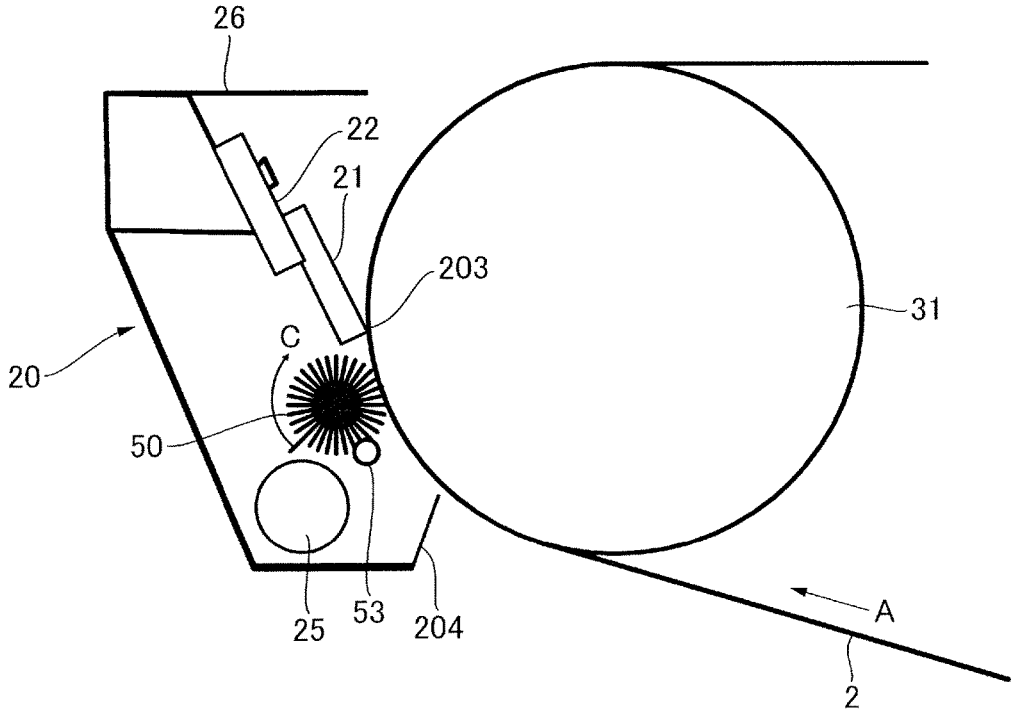
FIG. 3 is a schematic section view of a cleaning unit illustrating a configuration thereof.

The belt cleaning unit 20 illustrated in FIG. 3 employs a configuration in which an auxiliary member is used with a blade system. The belt cleaning unit 20 includes a brush roller 50 and a cleaning blade 21 in a housing 26 disposed so as to oppose the tension roller 31 with the belt 2 interposed therebetween. The cleaning blade 21 is disposed downstream of the secondary transfer portion T2 in the rotation direction of the belt 2 serving as a predetermined direction and contacts (rubs) the belt 2. The brush roller 50 is disposed between the secondary transfer portion T2 and the cleaning blade 21 in the rotation direction of the belt 2, and rubs the belt 2. The cleaning blade 21 and the brush roller 50 are replaceable.

The brush roller 50 is formed by bristling an outer peripheral surface of a conductive core metal with, for example, carbon-dispersed nylon fiber having a resistance of 10 MΩ, a length of 4 mm, and a thickness of 6 denier in a bristling density of 70,000/$inch^2$. The brush roller 50 is in contact with the belt 2 at a position opposing the tension roller 31 with the belt 2 interposed therebetween with an amount of intrusion of about 1.0 mm. The brush roller 50 is rotated in a direction, i.e. an arrow C direction in FIG. 3, opposite to the rotation direction of the belt 2 at a position to be in contact with the belt 2 by a brush roller driving motor that is not illustrated. The brush roller 50 rotates to remove the transfer residual toner and paper dust from the belt 2.

A flicker 53, which is a metal bar, is disposed at a position in the brush roller 50 at a distance of about 1.0 mm from a distal end portion of the outer periphery of the brush roller 50. The transfer residual toner attached to the brush roller 50 is scraped off with the paper dust by the flicker 53. The transfer residual toner and paper dust scraped off the brush roller 50 is conveyed by a collected toner conveyance screw 25 and is discharged to a collection container that is not illustrated.

The cleaning blade 21 is disposed downstream of the brush roller 50 in the rotation direction of the belt 2. The cleaning blade 21 is constituted by a cleaning metal sheet 22 and a rubber member attached to the distal end of the cleaning metal sheet 22. For the rubber member, for example, polyurethane rubber is used because polyurethane rubber does not damage the belt 2 and has a high abrasion resistance. In the case where a material with a small distortion is preferred, two-liquid thermosetting polyurethane may be employed. Alternatively, styrene-butadiene copolymer, chloroprene, butadiene rubber, ethylene-propylene-diene rubber, chlorosulfonated polyethylene rubber, fluorine rubber, silicone rubber, or the like may be employed. The cleaning blade 21 is formed such that, for example, the length thereof in a longitudinal direction, that is, a direction of rotation axis of the tension roller 31, is 340 mm, the thickness thereof is 2 mm, the length thereof in a short-side direction is 15 mm, and the length of a free end of the polyurethane rubber is about 8 mm.

The cleaning blade 21 is disposed to be in contact with the belt 2 such that the edge thereof is directed against the rotation direction of the belt 2 indicated by the arrow A in FIG. 1. At a position at which the cleaning blade 21 is in contact with the belt 2 on the tension roller 31, the cleaning blade 21 rubs the surface of the belt 2, and mechanically scrapes off the transfer residual toner and the like on the belt 2. That is, at the position at which these two are in contact with each other, rubbing portion 203 corresponding to an abutting position is formed. The transfer residual toner and the like scraped off the belt 2 is discharged to the collection container that is not illustrated. The cleaning blade 21 also scrapes off wax and the like attached to the belt 2 in image formation.

The belt cleaning unit 20 includes a scattering prevention sheet 204 provided on the upstream side in the rotation direction of the belt 2 so as to cover a gap between the belt 2 and the housing 26. The scattering prevention sheet 204 prevents the transfer residual toner and the paper dust from leaking to the outside of the housing 26 when removing the transfer residual toner and the paper dust from the belt 2. The scattering prevention sheet 204 is formed of, for example, a sheet material of polyethylene terephthalate resin having a thickness of 20 to 50 μm.

In the case where the belt 2, which is stretched by plural rollers, is rotated, the rotated belt 2 moves in the width direction, which is parallel to the rotation axis of the tension roller 31 in the exemplary embodiments, and thus is likely to be offset to one end side of rollers including the tension roller 31 or meander. This may be caused by a dimensional error of the belt 2 or the rollers supporting the belt 2. Examples of the dimensional error include variation of surface shape, variation of precision between the width direction and the circumferential direction, and displacement of positions at which the rollers are disposed. In the case where the offset or meandering occurs, the belt 2 may exceed a range in which the belt 2 can be stretched by the rollers, and thus the belt 2 may come off the rollers and drop, or come into contact with another component and damage the component. Therefore, in order not to cause the offset or meandering, a steering system is employed in the exemplary embodiments. In the steering system, one or two of plural rollers stretching the belt 2 are tilted as steering rollers to move the rotating belt 2 in the width direction, and thus the offset or meandering of the belt 2 is suppressed.

Steering Mechanism

A steering mechanism based on a steering system capable of suppressing the offset or meandering of the belt 2 will be described with reference to FIG. 4. Here, a case where the tension roller 31 is tilted as a steering roller will be described as an example. For the sake of better understanding of description, illustration of the primary transfer rollers 8Y to 8K, the secondary transfer inner roller 33, and so forth illustrated in FIG. 1 is partially omitted in FIG. 4.

A steering mechanism 40 includes a steering arm 41, an eccentric cam 42, and a steering motor 43. The steering arm 41 rotatably supports a shaft of the tension roller 31. The steering arm 41 is formed in a long shape, and the eccentric cam 42 is provided to be in contact with a side surface of a second end of the steering arm 41 opposite to a first end of the steering arm 41 supporting the shaft of the tension roller 31. The eccentric cam 42 is rotated by the steering motor 43. The steering arm 41 is supported by, for example, an apparatus body that is not illustrated, such that the side thereof supporting the shaft of the tension roller 31 can swing in a large scale in accordance with the rotation of the eccentric cam 42. That is, a tilting position of the tension roller 31 can be continuously changed by driving the steering motor 43. The tilting position of the tension roller 31 is specifically an angle at which the tension roller 31 is disposed with respect to the driving roller 32. According to this, an alignment, that is, a degree of parallelism, of the tension roller 31 with respect to the driving roller 32 is adjusted, and the belt 2 can move in the width direction, that is, the direction of rotation axis of the tension roller 31, intersecting with the rotation direction of the belt 2. To be noted, a cutout portion that is not illustrated is defined in the eccentric cam 42. The cutout portion is detected by a sensor or the like that is not illustrated. The tilting position of the tension roller 31 is determined on the basis of the position of the cutout portion of the eccentric cam 42.

Edge Sensor

Figure 4:
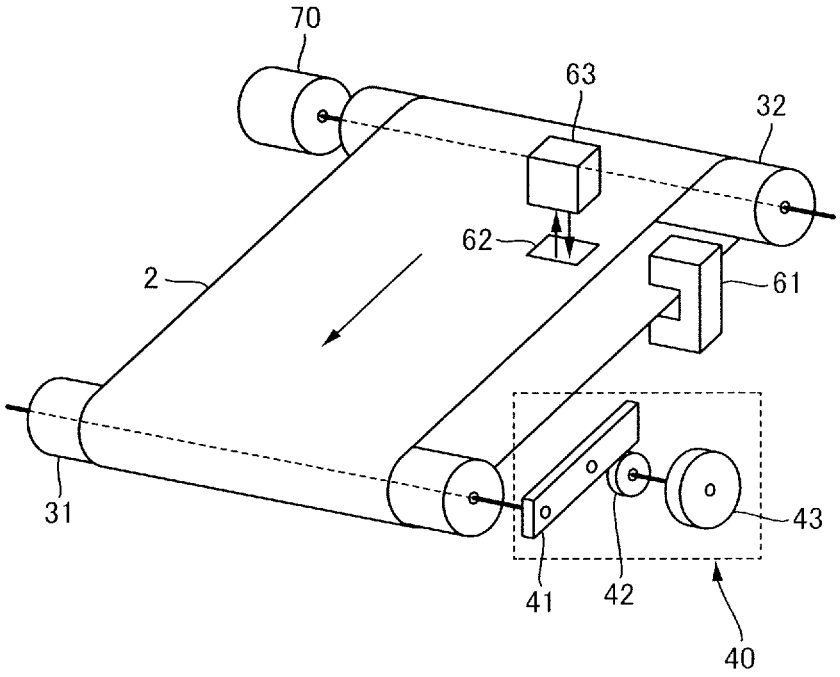
FIG. 4 is a perspective view of a steering mechanism.

In addition, as illustrated in FIG. 4, an edge sensor 61 for detecting an edge position of the belt 2 in the width direction serving as a position in the width direction is provided in a position along a rotation path of the belt 2. The edge sensor 61 serving as a detection portion detects the position of the belt 2 in the width direction, and generates a belt position detection signal corresponding to the offset of the belt 2. The edge sensor 61 is, for example, an optical sensor including a light emitting portion and a light receiving portion disposed so as to oppose each other, and detects the position of the belt 2 in the width direction on the basis of the amount of light received by the light receiving portion varying in accordance with the amount of belt 2 inserted between the light emitting portion and the light receiving portion.

Rotation Position Sensor

Further, a rotation position sensor 63 that detects the belt 2 having reached a predetermined rotation position is provided in the vicinity of the surface of the belt 2. The rotation position sensor 63 detects a position seal 62 attached to the surface of the belt 2, and outputs a rotation standard signal for each rotation of the belt 2. For example, the rotation position sensor 63 is a reflection sensor capable of detecting an amount of light reflected on the belt 2. The amount of light received by the rotation position sensor 63 varies between a case where a portion to which the position seal 62 is attached passes under the rotation position sensor 63 and a case where another portion passes under the rotation position sensor 63. The position of the belt 2 in the rotation direction can be detected on the basis of this variation of the amount of received light.

Control Portion

Figure 5:
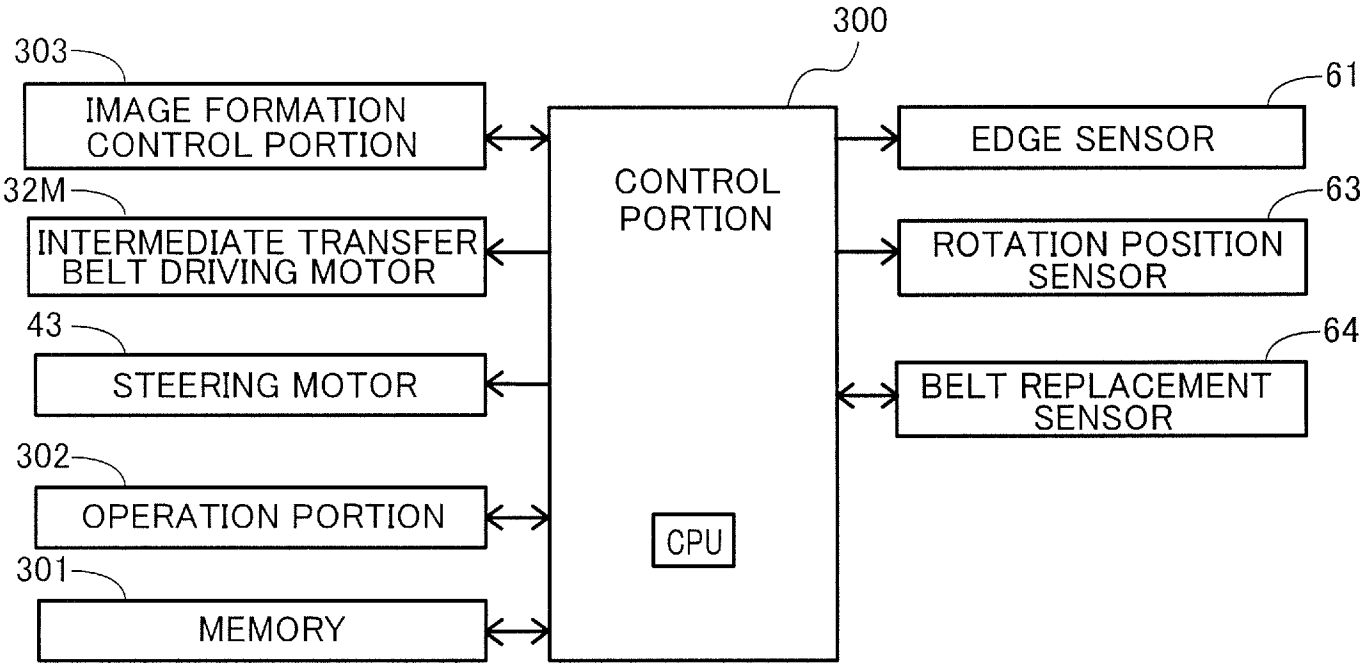
FIG. 5 is a block diagram illustrating a control portion according to the exemplary embodiments.

The image forming apparatus 1 includes a control portion 300. The control portion 300 will be described with reference to FIG. 5. As illustrated in FIG. 5, the control portion 300 is connected to a memory 301, an operation portion 302, an image formation control portion 303, the intermediate transfer belt driving motor 32M, the steering motor 43, the edge sensor 61, the rotation position sensor 63, a belt replacement sensor 64, and so forth. To be noted, although the control portion 300 illustrated in FIG. 5 is connected to the fixing unit 38 described above and so forth in addition to the illustrated components, the illustration and description thereof is omitted herein because the connection is not the main focus of the invention.

The control portion 300 is, for example, a central processing unit: CPU that performs various control of the image forming apparatus 1 such as control of image formation. The memory 301 is a storage device such as a read only memory: ROM, a random access memory: RAM, or a hard disc device. The memory 301 stores various control programs, data, and so forth for controlling the image forming apparatus 1. For example, in the exemplary embodiments, the memory 301 stores various control programs for image formation jobs and adjustment processing in an adjustment mode that will be described later with reference to FIG. 8, and various data such as edge shape data. In addition, the memory 301 is capable of temporarily storing results of computation and so forth accompanied by execution of the various control programs. To be noted, an image formation job corresponds to a series of operations from the start of image formation based on a print signal for forming an image on the recording material P to completion of the image formation. Specifically, an image formation job corresponds to a period from pre-rotation to post-rotation after receiving the print signal and includes a period of image formation and an interval between sheets. The pre-rotation is a preparatory operation before image formation, the post-rotation is an operation after image formation, and the interval between sheets is a period in which image formation is not performed.

The operation portion 302 receives input of a starting operation of execution of various programs such as an image formation program and input of various data from an operator. The operation portion 302 may include, for example, an operation panel including a touch panel display, a display panel, and an input button. Although the operation portion 302 may be provided in the body of the image forming apparatus 1, the operation portion 302 may be configured as an external terminal separate from the image forming apparatus 1. In the exemplary embodiments, an operation panel including a touch panel display is used as the operation portion 302.

Figure 6:
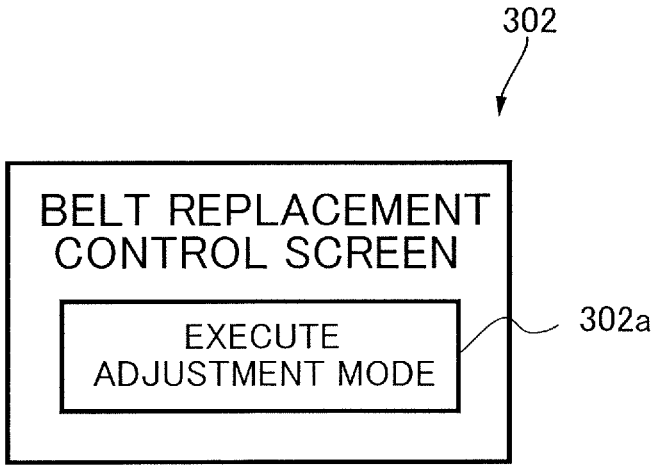
FIG. 6 illustrates an operation portion including an operandum for executing an adjustment mode.

In the exemplary embodiments, in the case where the belt 2 has been replaced by a user or a maintenance person, the control portion 300 displays a "belt replacement control screen" illustrated in FIG. 6 on the operation portion 302 before receiving the first image formation job after replacement of the belt 2 or before executing formation of the first image. As illustrated in FIG. 6, an instruction button 302*a* is displayed in the "belt replacement control screen" displayed on the touch panel. The instruction button 302*a* is used for making an instruction of executing an adjustment mode as an instruction related to an operation of replacing the belt 2. The control portion 300 is capable of executing the adjustment mode in accordance with a touch operation on the instruction button 302*a* on the operation portion 302 performed by an operator as an input related to the operation of replacing the belt 2. That is, in the case where an instruction of executing the adjustment mode is input to an input portion of the operation portion 302, the control portion 300 executes an adjustment mode stored in the memory 301 in advance. In this way, it is configured that the adjustment mode is executed before starting the first image formation job after replacement of the belt 2. In the adjustment mode, the tension roller 31 is tilted while rotating the belt 2, and thus the positional relationship between the belt 2 and the tension roller 31 is adjusted. The details of the adjustment mode will be described later. The edge shape data is generated when executing the adjustment mode. The control portion 300 also performs a toner supplying operation in at least one period of before, during, and after execution of the adjustment mode.

Input related to the replacement of the belt 2 is preferably made after the replacement of the belt 2 is completed as described above. However, the input may be made before starting the replacement of the belt 2 or during the replacement of the belt 2.

The touch panel of the operation portion 302 provides information that may cause the operator to instruct the execution of the adjustment mode to the operator, and how the information is provided is not limited to the "belt replacement control screen" illustrated in FIG. 6. The information may be provided by displaying a mark or via voice guidance.

In addition, the input portion that the operation portion 302 includes for the operator to input the instruction of execution of the adjustment mode is not limited to the instruction button 302*a* displayed on the touch panel illustrated in FIG. 6. An input device other than a touch panel such as a voice input device may be also employed. Alternatively, a button switch may be provided in the apparatus body such that a user or a maintenance person of the apparatus can push the button switch.

In the exemplary embodiments, the belt replacement sensor 64 serving as a replacement detection portion is provided for detecting the belt 2 having been replaced by the user or maintenance person of the apparatus. The belt replacement sensor 64 detects a change in the attitude of a roller occurring at the time of replacement of the belt 2, and transmits information concerning the change to the control portion 300.

The replacement detection portion may detect the replacement via other methods than detecting the change in the attitude of a roller. For example, the belt 2 being attached after being detached may be detected by using an optical sensor that recognizes whether or not the belt 2 is attached. Alternatively, the replacement of the belt 2 may be detected by providing a barcode or an integrated circuit tag: IC tag with which each belt can be identified on the belt 2 and identifying the belt 2 by a sensor provided in the image forming apparatus. Moreover, the replacement detection portion may be configured without a sensor such that the completion of the replacement may be input by the user or maintenance person by using the operation portion 302 or a button switch after completing the replacement of the belt 2.

In the exemplary embodiments, the control portion 300 provides the information that may cause the operator to instruct the execution of the adjustment mode after detection of the replacement of the belt 2, and executes the adjustment mode after the instruction to execute the adjustment mode is input to the operation portion 302. However, another configuration may be employed. For example, the control portion 300 may wait for the input of the instruction to execute the adjustment mode without displaying the information that may cause the operator to instruct the execution of the adjustment mode. Alternatively, the control portion 300 may perform control such that the adjustment mode is automatically executed once the replacement of the belt 2 is detected. The control portion 300 also performs a toner supplying operation in at least one period of before, during, and after execution of the adjustment mode.

Any configuration may be employed for the replacement detection portion as long as information related to replacement of the belt 2 can be detected. For example, instead of the configuration in which the completion of the replacement is detected as described above, a configuration in which it is detected in advance that the belt 2 is to be replaced and a configuration in which the replacement being performed is detected may be employed. As another example, a use state of the image forming apparatus 1 may be monitored and the belt 2 having reached a time for replacement may be detected.

The image formation control portion 303 controls the image forming portions 3Y to 3K in accordance with signals, or commands, from the control portion 300. Specifically, the image formation control portion 303 controls the rotation speed and rotation time of the photosensitive drums 4Y to 4K and developing sleeves 7SY to 7SK described above, a laser intensity of exposing units 6Y to 6K, and so forth. In addition, the image formation control portion 303 controls the charging voltage from the charging power source V1, the developing voltage from the developing power source V2, and the direct current voltage from the primary transfer high-voltage power source D1 of each of the image forming portions 3Y to 3K, and the direct current voltage from the secondary transfer high-voltage power source D2. The control portion 300 is capable of controlling the image formation control portion 303 to supply toner onto the belt 2.

The control portion 300 is connected to the intermediate transfer belt driving motor 32M that drives the driving roller 32. The intermediate transfer belt driving motor 32M is driven in accordance with a signal, or a command, from the control portion 300, and thus the belt 2 is rotated or stopped by the driving roller 32. The control portion 300 is connected to the steering motor 43. The control portion 300 is capable of continuously changing the tilting position of the tension roller 31 by driving the steering motor 43. In addition, the control portion 300 is capable of receiving signals output from the edge sensor 61 and the rotation position sensor 63 described above.

Steering Control and Edge Shape Data

As has been described, the control portion 300 is capable of controlling the tilt of the tension roller 31 by performing steering control at the time of an image formation job, that is, at the time of performing image formation. In the steering control, the tension roller 31 illustrated in FIG. 4 is tilted moment to moment, and thus positioning of the belt 2 in the width direction is dynamically performed. The control portion 300 calculates an amount of meandering of the belt 2 by comparing a belt position detection signal from the edge sensor 61 with edge shape data, and calculates, on the basis of the calculated amount of meandering of the belt 2, an amount of change in the tilting position of the tension roller 31 required for settling the meandering of the belt 2. Then, the control portion 300 outputs a driving signal corresponding to the calculated amount of change in the tilting position to the steering motor 43. According to this, the steering motor 43 rotates the eccentric cam 42 illustrated in FIG. 4, and thus the tilting position of the tension roller 31 is changed. In the case where the tilting position of the tension roller 31 is appropriately changed on the basis of the belt position detection signal from the edge sensor 61, as a result of this, the belt 2 can be stably rotated without occurrence of offset or meandering.

The edge shape data used for the steering control is newly generated and stored in the memory 301 in correspondence with a new belt 2 each time the belt 2 is replaced. To be noted, as has been already described, the abutting portion 203 illustrated in FIG. 3 is in the toner lack state in which hardly no toner is present therein immediately after the replacement of the belt 2. In the toner lack state, adhering matter is likely to be formed on the belt 2. In particular, in the case where the surface of the belt 2 is coated with a releasing agent or is roughened by rubbing, the amount of attached matter attached to the surface of the belt 2 tends to be larger, and thus adhering matter is more likely to be formed on the belt 2. The adhering matter formed on the belt 2 may cause image defects such as stripe density irregularity or damage the cleaning blade 21.

Figure 7:
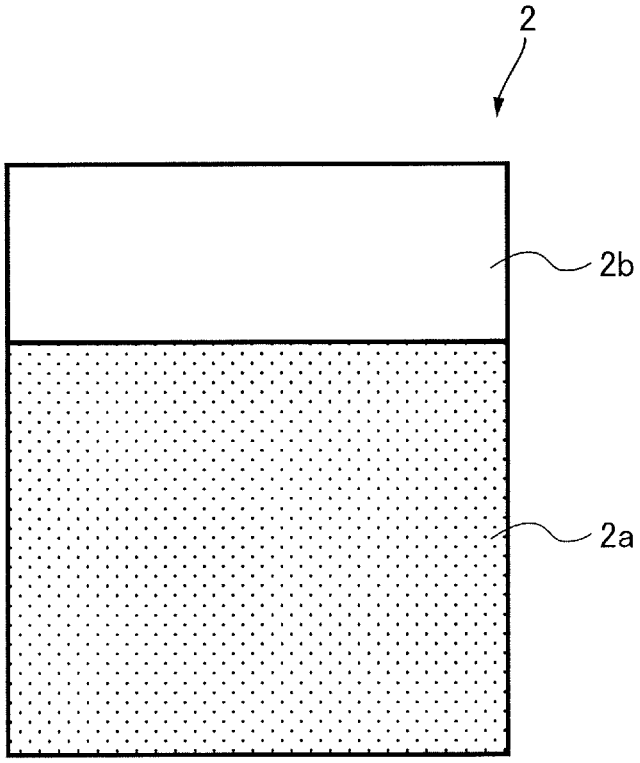
FIG. 7 is a section view of an intermediate transfer belt illustrating a structure thereof.

In the exemplary embodiments, the belt 2 is formed by coating a base material 2*a* with a surface layer 2*b* as illustrated in FIG. 7. The base material 2*a* is formed of polyimide resin or polyether ether ketone resin, and the surface layer 2*b* is formed of acrylic resin containing fluorine resin added thereto. In the toner lack state, resin of the surface layer 2*b* scraped off by the cleaning blade 21 is likely to be accumulated in the rubbing (abutting) portion 203 illustrated in FIG. 3, and is likely to adhere onto the belt 2 as a streak-shaped protrusion when the belt 2 is stopped. Since the cleaning blade 21 is provided so as to extend in the short-side direction of the belt 2, the adhering matter is formed in the short-side direction of the belt 2 in the toner lack state.

In addition, in the exemplary embodiments, the surface of the belt 2 is roughened along the rotation direction by a roughening member such as sand paper. In the roughened surface of the belt 2, multiple fine structures including recesses and projections are formed in a streak shape along the rotation direction. In the toner lack state, shavings of the resin are likely to be caught on the surface of the belt 2 and remain as attached matter.

The shavings of the resin are scraped off by the cleaning blade 21 and accumulate in the rubbing portion 203 illustrated in FIG. 3, and may adhere to the belt 2. The adhering matter formed on the belt 2 may push up the cleaning blade 21 in a direction moving away from the surface of the belt 2. In the case where the cleaning blade 21 is pushed up, the amount of toner passing through the rubbing portion 203 without being scraped off increases. That is, the adhering matter may cause failure in cleaning that causes image defects. In addition, the adhering matter formed by cooled and hardened resin is harder than the cleaning blade 21, which is specifically a rubber member, and thus may cause a crack in the rubber member at the time of rubbing, or may cause the rubber member to come off the cleaning metal sheet 22.

Therefore, in the exemplary embodiments, considering what has been described above, toner is supplied to the rubbing portion 203 illustrated in FIG. 3 between the belt 2 and the cleaning blade 21 so as to cancel the toner lack state of the rubbing portion 203 when performing a process of generating edge shape data corresponding to the new belt 2 after replacement. In the case where toner is supplied, a toner layer is formed in the rubbing portion 203, and thus adhering matter that causes image defects or damages the cleaning blade 21 is less likely to be formed on the belt 2. The description will be given below.

First Exemplary Embodiment

An adjustment mode, in other words, adjustment processing, according to a first exemplary embodiment will be described with reference to FIG. 8 and also to FIGS. 1 and 3 to 5, and so forth as appropriate. In the description below, a case where a toner belt is formed by using all colors of yellow, magenta, cyan, and black will be described as an example. In this case, one toner belt may be formed on the belt 2 by superimposing toner belts of respective colors, and the toner belts of respective colors may be individually formed without superimposing the toner belts. In addition, a toner belt of a single color of, for example, black, may be formed instead of using all the colors.

Figure 8:
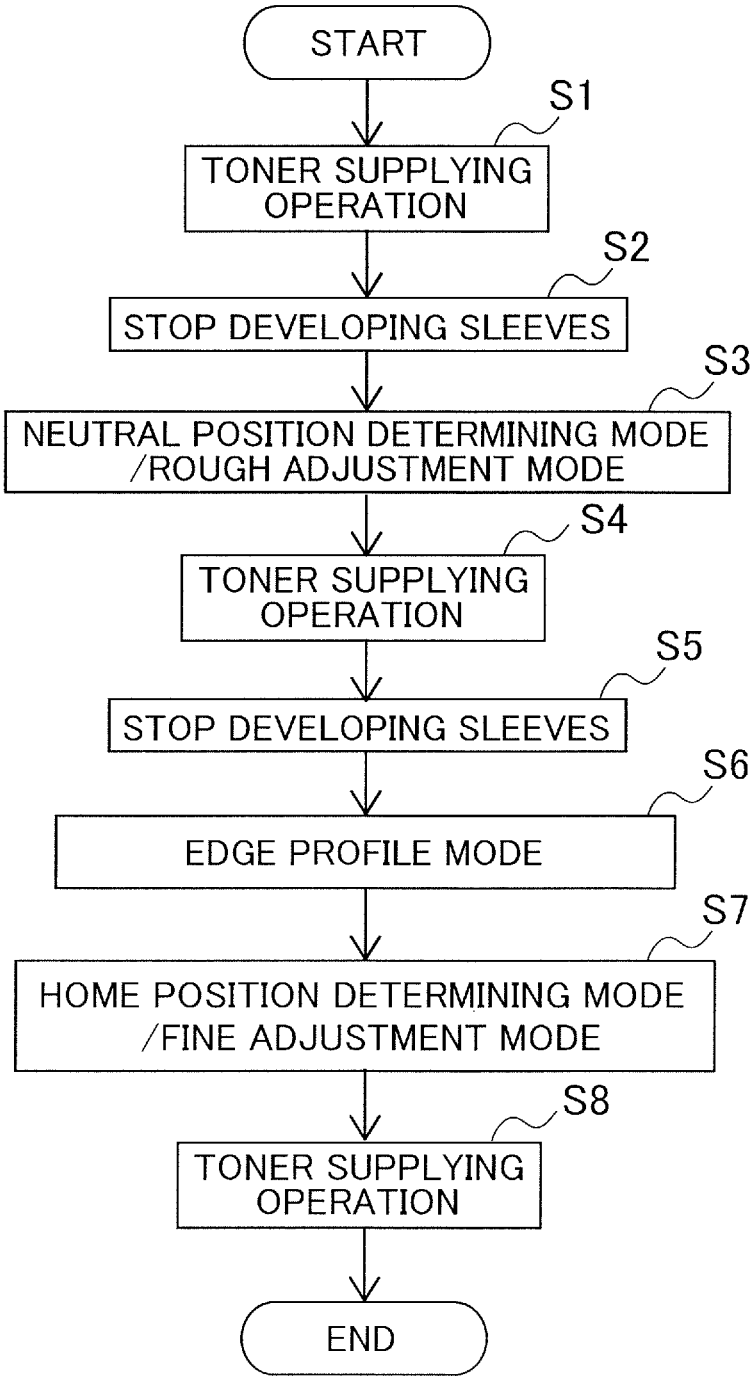
FIG. 8 is a flowchart illustrating an adjustment mode according to a first exemplary embodiment.

FIG. 8 is a flowchart illustrating each step included in the adjustment mode of the present exemplary embodiment.

As illustrated in FIG. 8, in step S1, the control portion 300 performs a "toner supplying operation" at the start of the adjustment mode. The "toner supplying operation" is performed before a "neutral position determining mode" is executed in step S3 that will be described later, that is, when the tilting of the tension roller 31 is stopped. In the "toner supplying operation", a toner belt for supplying toner to the rubbing portion 203 is formed on the belt 2. That is, the control portion 300 controls the intermediate transfer belt driving motor 32M and the image formation control portion 303 to rotate the belt 2, the photosensitive drums 4Y to 4K, and the developing sleeves 7SY to 7SK. In this state, the control portion 300 applies the charging voltage, the developing voltage, and the primary transfer bias similarly to the time of an image formation job, and exposes the photosensitive drums 4Y to 4K to form belt-shaped patterns, and thus a solid toner belt is formed on the belt 2. The toner belt serving as a toner image for supplying toner to the rubbing portion 203 may be formed in any length in the rotation direction of the belt 2 as long as the toner belt is as long as or longer than the rubbing portion 203 in the width direction of the belt 2.

In the "toner supplying operation", the primary transfer high-voltage power source D1 applies the primary transfer bias to the primary transfer rollers 8Y to 8K, and the primary transfer bias may be set to 0 V, which is a different value from the time of an image formation job. This is for supplying toner also to the cleaning blades 9Y to 9K that are respectively in contact with the photosensitive drums 4Y to 4K. In addition, a weak secondary transfer bias of a negative polarity is preferably applied to the secondary transfer outer roller 34 by the secondary transfer high-voltage power source D2 unlike at the time of an image formation job. Further, secondary transfer biases of positive and negative polarities may be alternately applied after toner passes through the secondary transfer portion T2. According to this, toner on the belt 2 is less likely to attach to the secondary transfer outer roller 34, and thus almost all toner of the formed toner belt can be supplied to the rubbing portion 203. Alternatively, the secondary transfer outer roller 34 may be separated from the belt 2 such that toner does not attach to the secondary transfer outer roller 34.

Referring back to FIG. 8, in step S2, the control portion 300 stops the developing sleeves 7SY to 7SK after performing the "toner supplying operation" in step S1, and then, in step S3, executes the "neutral position determining mode". The "neutral position determining mode" will be hereinafter referred to as a "rough adjustment mode". In the "rough adjustment mode" serving as a first mode, the tension roller 31 is tilted to plural tilting positions, and the amount of variation of the position of the belt 2 in the width direction in one rotation detected by the edge sensor 61 is obtained for each of the plural tilting positions. That is, the control portion 300 drives the steering motor 43 in a state in which the belt 2 is rotated without a toner image and thus changes stepwise the tilting position of the tension roller 31 to predetermined angles. The control portion 300 stores, in the memory 301 and for each tilting position, the position of the belt 2 in the width direction in one rotation obtained by the edge sensor 61. The position of the belt 2 in the width direction in one rotation stored in the memory 301 for each tilting position is used when temporarily setting a tilting position of the tension roller 31 at which the belt 2 stably rotates as a neutral position. In the present exemplary embodiment, the belt 2 is rotated without a toner image for a predetermined period of time in the "rough adjustment mode". In the present exemplary embodiment, the predetermined period of time is about three minutes. In this period, the formation of toner belt on the belt 2 to supply toner to the rubbing portion 203 is not performed. This is because precise positioning cannot be performed in the case where a toner belt is formed during the "rough adjustment mode". The formation of toner belt on the belt 2 to supply toner to the rubbing portion 203 is neither performed during an "edge profile mode" of step S6 and a "home position determining mode" of S7 for the same reason.

In the present exemplary embodiment, the rotation of the developing sleeves 7SY to 7SK are stopped and the primary transfer bias and the secondary transfer bias are turned off, that is, are not applied, during the "rough adjustment mode" in order to suppress degradation of developer. This is because in the case where the primary transfer bias is on during the "rough adjustment mode", an electrical discharge product is generated on the belt 2, and, due to the electrical discharge product, the coefficient of friction between the belt 2 and the cleaning blade 21 increases and the cleaning blade 21 becomes more likely to be turned up. In the present exemplary embodiment, since the primary transfer bias and the secondary transfer bias are turned off during the adjustment mode except in the "toner supplying operation" in which a toner belt is formed, the cleaning blade 21 is less likely to be turned up.

In contrast, the belt 2 is driven in a state in which the first transfer bias and the second transfer bias are turned on, that is, are applied, at the time of performing an image formation job. Therefore, the cleaning blade 21 may be turned up in the case where toner in the rubbing portion 203 of the cleaning blade 21 is exhausted at the time of performing the image formation job. Hence, a "black belt mode" of supplying a toner belt to the cleaning blade 21 is executed at a predetermined timing at the time of performing the image formation job. Specifically, when performing a successive image formation job in which image formation is successively performed on plural recording materials P, a toner belt is formed each time image formation on a predetermined number of sheets is finished. In this way, turning up of the cleaning blade 21 is suppressed.

To be noted, in the "black belt mode", a toner belt is formed when a predetermined condition is satisfied while performing the successive image formation job. In the present exemplary embodiment, the predetermined condition is that image formation on a predetermined number of sheets is finished. This timing is totally different from the timing at which a toner belt is formed in the "toner supplying operation" described above, that is, the timing at which the adjustment mode is executed before performing image formation for the first time after replacement of the belt 2. According to this, suppression of turning up of the cleaning blade 21 and generation of adhering matter can be performed at an appropriate timing during the successive image formation job and after replacement of the belt 2.

The control portion 300 performs the "toner supplying operation" in accordance with the stop of driving of the belt 2 in step S4 after executing the "rough adjustment mode" in step S3, that is, during the adjustment mode. The "toner supplying operation" performed in this step is the same as the operation performed in step S1 described above, and thus the description thereof is omitted herein.

After performing the "toner supplying operation" in step S4, the control portion 300 stops the developing sleeves 7SY to 7SK in step S5, and executes the "edge profile mode" in step S6. In the "edge profile mode" serving as a second mode, the control portion 300 fixes the tension roller 31 at a tilting position at which the amount of variation of the position of the belt 2 in the width direction in one rotation is the smallest among tilting positions stored in the memory 301. In other words, the control portion 300 fixes the tension roller 31 at the neutral position. Then, the control portion 300 rotates the belt 2 without a toner image in the state in which the tension roller 31 is fixed, and obtains the position of the belt 2 in the width direction detected by the edge sensor 61 in one rotation. The control portion 300 sets the position of the belt 2 in the width direction obtained in one rotation as edge shape data used for controlling the tilt of the tension roller 31 at the time of an image formation job, and stores the edge shape data in the memory 301. In the present exemplary embodiment, the belt 2 is rotated without a toner image for a predetermined period of time, in which toner is not supplied, in the "edge profile mode". The predetermined period of time is about twenty seconds in the present exemplary embodiment. During the "edge profile mode", the primary transfer bias and the secondary transfer bias are turned off.

The control portion 300 executes the "home position determining mode" in step S7. The "home position determining mode" will be hereinafter referred to as a "fine adjustment mode". When executing the "fine adjustment mode" serving as a third mode, the control portion 300 tilts the tension roller 31 on the basis of the position of the belt 2 in the width direction detected by the edge sensor 61 with the belt 2 being rotated without a toner image. Then, the control portion 300 sets a tilting position at which a difference between the position of the belt 2 in the width direction and the edge shape data stored in the memory 301 is the smallest as a standard position serving as a home position at which the tilting of the tension roller 31 is started at the time of an image formation job. That is, during the "edge profile mode", since the tilting position of the tension roller 31 is fixed, the belt 2 moves to one side in a certain rate. Therefore, the position of the belt 2 in the width direction is displaced from a predetermined position. Accordingly, the tension roller 31 is tilted to position the belt 2 at the predetermined position. Then, a tilting position of the tension roller 31 at which the position of the belt 2 in the width direction is the predetermined position is set as the home position. In the present exemplary embodiment, the belt 2 is rotated without a toner image for a predetermined period of time in the "fine adjustment mode", and the formation of a toner belt on the belt 2 to supply toner to the rubbing portion 203 is not performed during the predetermined period of time. In the present exemplary embodiment, the predetermined period of time is about three minutes. During the "fine adjustment mode", the primary transfer bias and the secondary transfer bias are turned off.

The control portion 300 performs the "toner supplying operation" in step S8 after executing the "fine adjustment mode" in step S7, that is, before finishing the adjustment mode. The "toner supplying operation" performed in this step is the same as the operation performed in step S1 described above, and thus the description thereof is omitted herein. Then, the control portion 300 finishes the adjustment mode.

Results of Experiment

Figure 9:
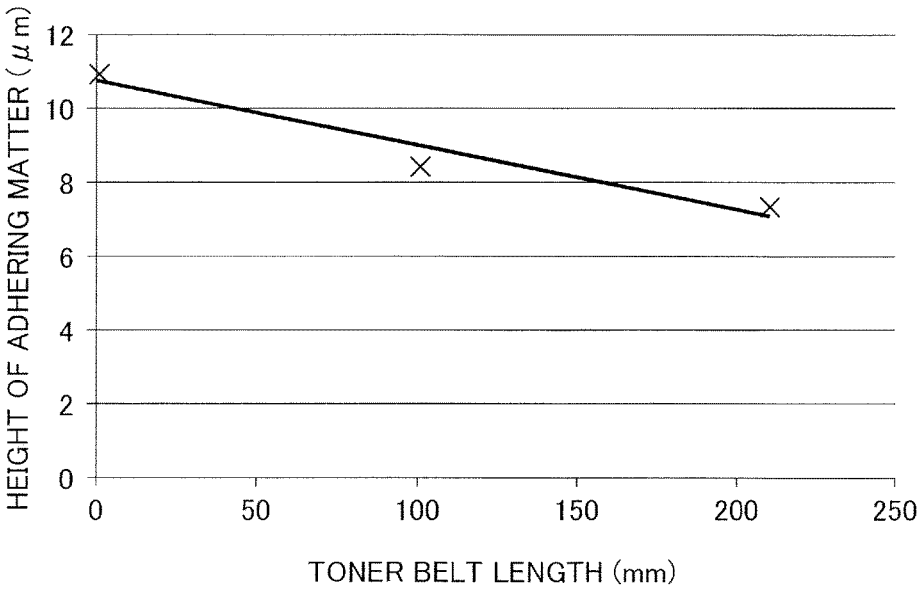
FIG. 9 is a graph illustrating a relationship between toner belt lengths and heights of adhering matter adhering to a belt in the case where the adjustment mode according to the first exemplary embodiment is executed.
Figure 10:
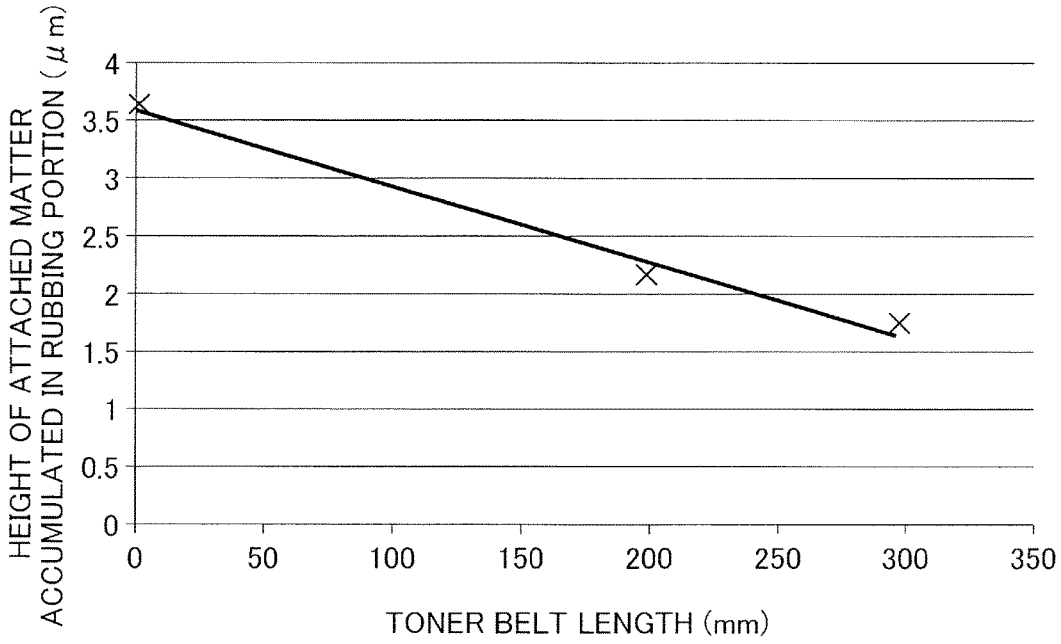
FIG. 10 is a graph illustrating a relationship between toner belt lengths and heights of attached matter accumulated in a rubbing portion in the case where the adjustment mode according to the first exemplary embodiment is executed.

The present inventor carried out an experiment of executing the "adjustment mode" described above while changing the length of the toner belt formed on the belt 2. The results of the experiment are shown in FIGS. 9 and 10. FIG. 9 illustrates heights of adhering matter adhering to the belt 2 in the case where the toner belt length is changed between 0 mm, 100 mm, and 210 mm. FIG. 10 illustrates heights of attached matter accumulated in the rubbing portion 203 in the case where the toner belt length is changed between 0 mm, 200 mm, and 300 mm. The toner belt length of 0 mm corresponds to a conventional example in which a toner belt is not formed.

Here, the image forming apparatus 1 was left stopped after executing the "adjustment mode", adhering matter formed in the rubbing portion 203 was moved downstream in the rotation direction of the belt 2 by rotating the belt 2 by hand after about an hour had elapsed, and the height of the adhering matter adhering to the belt 2 was measured by using a microscope. The height of attached matter accumulated in the rubbing portion 203 was measured by using a microscope for attached matter accumulated in the rubbing portion 203 on the upstream side of the belt 2 in the rotation direction after about one hour had elapsed with the image forming apparatus 1 left stopped after executing the "adjustment mode".

As illustrated in FIG. 9, the height of the adhering matter was about 11 μm in the case where the toner belt length was 0 mm. In contrast, the height of the adhering matter was about 9 μm in the case where the toner belt length was 100 mm. In addition, the height of the adhering matter was about 7 μm in the case where the toner belt length was 210 mm. Meanwhile, as illustrated in FIG. 10, the height of the attached matter was about 3.5 μm in the case where the toner belt length was 0 mm. In contrast, the height of the attached matter was about 2.3 μm in the case where the toner belt length was 200 mm. In addition, the height of the attached matter was about 1.7 μm in the case where the toner belt length was 300 mm.

As can be seen from FIGS. 9 and 10, the height of the adhering matter or attached matter decreases as the toner belt length increases, that is, as the amount of toner supplied to the rubbing portion 203 increases. In the case where the amount of supplied toner increases, the amount of toner staying at the rubbing portion 203 increases, and thus a toner layer is formed at the rubbing portion 203. This toner layer hinders intrusion of attached matter into the rubbing portion 203 and attachment of the attached matter to the belt 2, and, as a result of this, the height of the adhering matter and the height of the attached matter decreases. To achieve a greater effect, it is preferred that toner is supplied to the rubbing portion 203 before executing the "rough adjustment mode".

Since the attached matter is discharged with toner to the collection container that is not illustrated, the amount of toner in the toner layer formed at the rubbing portion 203 decreases as the time in which the belt 2 rotates becomes longer. In the case where the amount of toner in the toner layer decreases, the effect of hindering the intrusion of attached matter into the rubbing portion 203 and the attachment of attached matter to the belt 2 becomes less likely to be achieved. Therefore, in the present exemplary embodiment, toner is supplied to the rubbing portion 203 also after executing the "rough adjustment mode" and the "fine adjustment mode" such that the toner layer is replenished with toner and is more likely to be retained. In addition, attached matter that has been scraped off sometimes attaches to the rubbing portion 203 when executing the "rough adjustment mode" or the "fine adjustment mode". In such a case, if toner is supplied to the rubbing portion 203, the attached matter will be pushed out by the toner and thus removed from the rubbing portion 203. That is, adhering matter becomes less likely to be formed on the belt 2.

As described above, in the present exemplary embodiment, toner is supplied to the rubbing portion 203 before executing the "rough adjustment mode". According to this, a toner layer is formed at the rubbing portion 203, and an effect of hindering intrusion of attached matter into the rubbing portion 203 and attachment of attached matter to the belt 2 can be achieved. In addition, as a result of toner in the toner layer being mixed with the attached matter, the adhesive force of the attached matter can be reduced, and thus the attached matter on the belt 2 can be more easily scraped off. Further, toner is supplied to the rubbing portion 203 also after executing the "rough adjustment mode" and after executing the "fine adjustment mode". By supplying toner to the rubbing portion 203 also after executing the "rough adjustment mode" and the "fine adjustment mode, the toner layer is retained, and thus adhering matter becomes less likely to be formed on the belt 2.

In the present exemplary embodiment, formation of a toner belt on the belt 2 to supply toner is not performed when executing a mode, particularly the rough adjustment mode, in which the tension roller 31 may be tilted by a great degree. According to this, an effect that toner can be supplied to the rubbing portion 203 at an appropriate timing without causing the toner to scatter can be achieved.

Second Exemplary Embodiment

Figure 11:
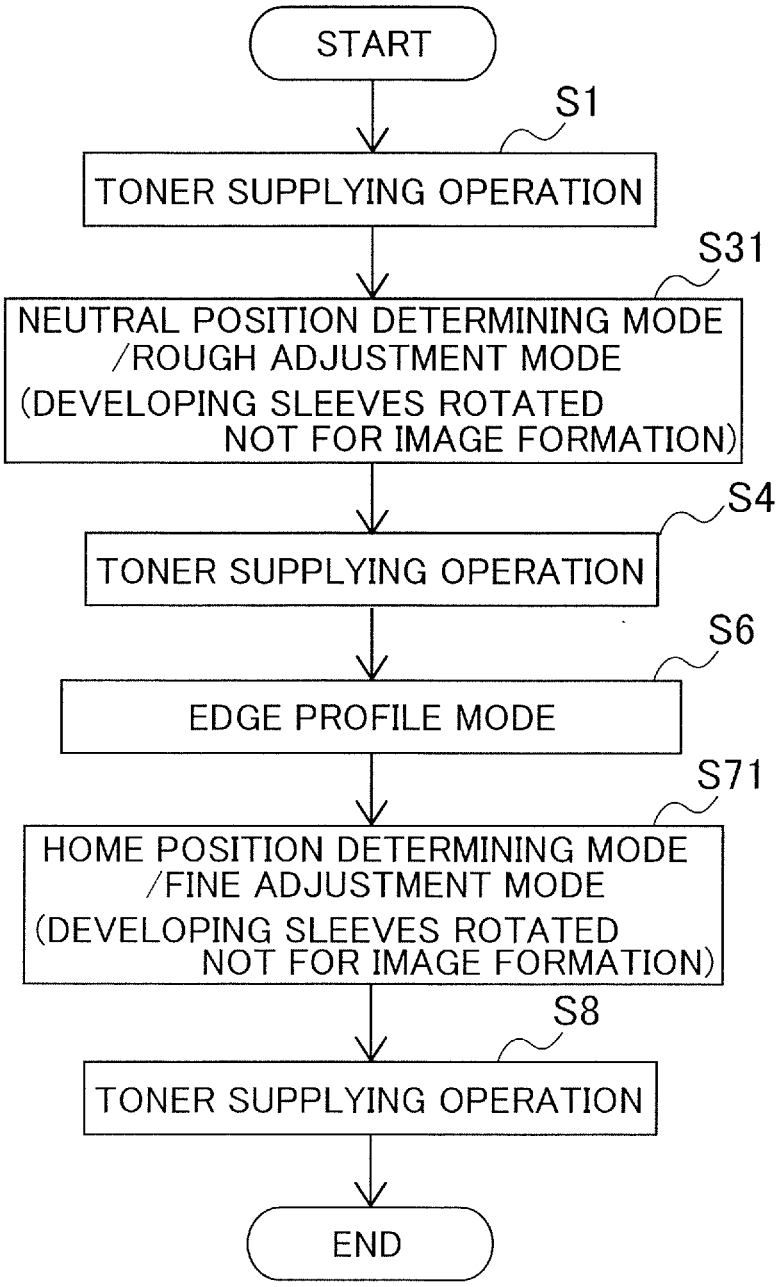
FIG. 11 is a flowchart illustrating an adjustment mode according to a second exemplary embodiment.

Next, a second exemplary embodiment will be described with reference to FIG. 11 and also to FIGS. 1 and 3 to 5, and so forth as appropriate. FIG. 11 illustrates a flowchart of an adjustment mode of the second exemplary embodiment. The adjustment mode illustrated in FIG. 11 is executed by the control portion 300 similarly to the adjustment mode of the first exemplary embodiment illustrated in FIG. 8. The adjustment mode illustrated in FIG. 11 is different from the adjustment mode illustrated in FIG. 8 in that the stopping processes of the developing sleeves 7SY to 7SK corresponding to steps S2 and S5 are not performed. In the description below, the same steps as in the processing of the first exemplary embodiment will be assigned with the same step numbers and described briefly.

As illustrated in FIG. 11, the control portion 300 performs the "toner supplying operation" in step S1. Then, unlike in the first exemplary embodiment, the control portion 300 executes the "rough adjustment mode" in step S31 without stopping the developing sleeves 7SY to 7SK, that is, with the developing sleeves 7SY to 7SK being rotated, after performing the "toner supplying operation" in step S1. The charging voltage and the developing voltage are applied such that the polarity of the potential of the photosensitive drums 4Y to 4K relative to the potential of the developing sleeves 7SY to 7SK is the same as the charging polarity of toner. In the present exemplary embodiment, when executing the "rough adjustment mode", the charging power source V1 and the developing power source V2 are controlled such that the potential of the photosensitive drums 4Y to 4K and the potential of the developing sleeves 7SY to 7SK have a relationship that makes toner more likely to be transferred onto the photosensitive drums 4Y to 4K. That is, the charging voltage and the developing voltage are applied such that the difference between the absolute value of the potential of the photosensitive drums 4Y to 4K and the absolute value of the potential of the developing sleeves 7SY to 7SK becomes smaller than in image formation. According to this, there is an electric field to move toner on the developing sleeves 7SY to 7SK onto the photosensitive drums 4Y to 4K, and thus the toner is moved from the developing sleeves 7SY to 7SK onto the photosensitive drums 4Y to 4K and then onto the belt 2. Since the photosensitive drums 4Y to 4K are not exposed, a toner belt of a high density is not formed on the belt 2. However, a certain amount of toner moves onto the whole area of the belt 2. In this way, toner is supplied to the rubbing portion 203 also at the time of the "rough adjustment mode".

The control portion 300 performs the "toner supplying operation" in step S4 after executing the "rough adjustment mode" in step S31. Then, unlike in the first exemplary embodiment, the control portion 300 executes the "edge profile mode" in step S6 and the "fine adjustment mode" in step S71 without stopping the developing sleeves 7SY to 7SK, that is, with the developing sleeves 7SY to 7SK being rotated, after performing the "toner supplying operation" in step S4. In the present exemplary embodiment, toner is supplied to the rubbing portion 203 by moving toner from the photosensitive drums 4Y to 4K onto the belt 2 as described above also at the time of the "edge profile mode" and the "fine adjustment mode". Then, the control portion 300 performs the "toner supplying operation" in step S8, and finishes the adjustment mode.

Results of Experiment

Figure 12:
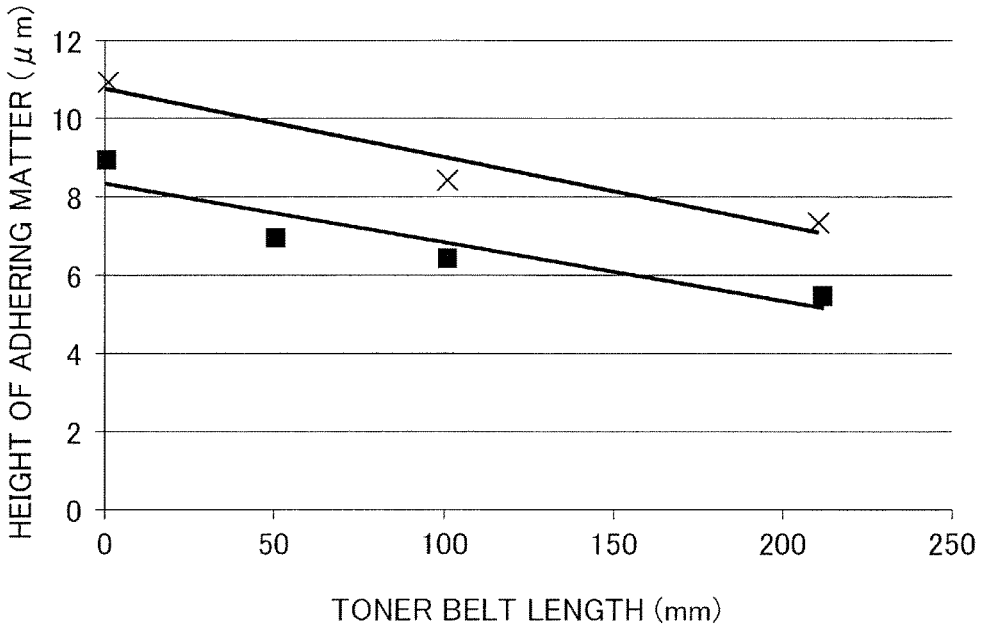
FIG. 12 is a graph illustrating a relationship between toner belt lengths and heights of adhering matter adhering to the belt in the case where the adjustment mode according to the second exemplary embodiment is executed.
Figure 13:
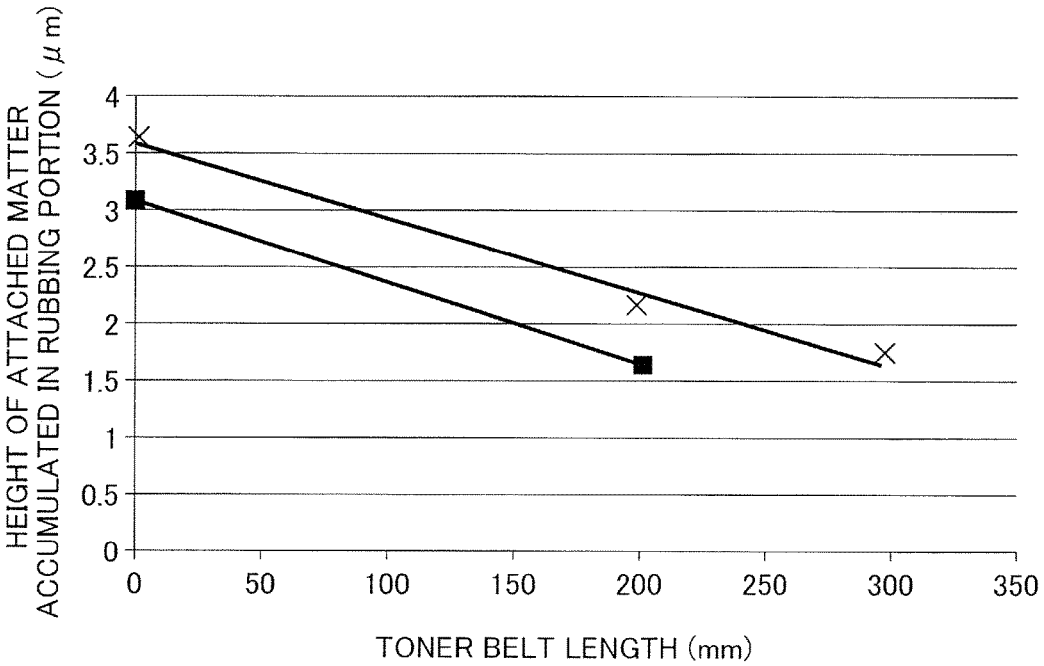
FIG. 13 is a graph illustrating a relationship between toner belt lengths and heights of attached matter accumulated in the rubbing portion in the case where the adjustment mode according to the second exemplary embodiment is executed.

The present inventor carried out, for the case of the first exemplary embodiment in which the rotation of the developing sleeves 7SY to 7SK is stopped and the case of the second exemplary embodiment in which the rotation of the developing sleeves 7SY to 7SK is not stopped, an experiment of executing the "adjustment mode" described above while changing the toner belt length. The results of the experiment are shown in FIGS. 12 and 13. FIG. 12 illustrates the relationship between toner belt lengths and heights of adhering matter adhering to the belt 2. FIG. 13 illustrates the relationship between toner belt lengths and heights of attached matter accumulated in the rubbing portion 203. In FIGS. 12 and 13, results of the first exemplary embodiment are indicated by crosses, and results of the second exemplary embodiment are indicated by solid black squares. The case where the toner belt length is 0 mm of the first exemplary embodiment corresponds to a conventional example. The height of adhering matter adhering to the belt 2 and the height of attached matter accumulated in the rubbing portion 203 were measured in the same manner as in the first exemplary embodiment.

As can be seen from FIGS. 12 and 13, in the results of the second exemplary embodiment in which the rotation of the developing sleeves 7SY to 7SK was not stopped, both of the heights of adhering matter and the heights of attached matter were smaller than in the results of the first exemplary embodiment in which the rotation of the developing sleeves 7SY to 7SK was stopped. The rate of decrease in the height is almost the same for every toner belt length. In addition, both of the height of adhering matter and the height of attached matter can be reduced also in the case of the toner belt length of 0 mm by just rotating the developing sleeves 7SY to 7SK.

As described above, toner is supplied to the rubbing portion 203 before executing the "rough adjustment mode" also in the adjustment mode of the second exemplary embodiment similarly to the adjustment mode of the first exemplary embodiment. In addition, toner is supplied to the rubbing portion 203 also after executing the "rough adjustment mode" and after executing the "fine adjustment mode". Accordingly, the same effect as the first exemplary embodiment described above can be achieved. That is, the effect of hindering intrusion of attached matter into the rubbing portion 203 and attachment of attached matter to the belt 2 and facilitating scraping off the attached matter on the belt 2 can be achieved. In addition, in the adjustment mode of the second exemplary embodiment, toner is supplied to the rubbing portion 203 also while the "rough adjustment mode", the "edge profile mode", and the "fine adjustment mode" are executed by the control portion 300. As has been already described, this is performed in order to retain a toner layer by supplying toner to the toner layer during the "rough adjustment mode", the "edge profile mode", and the "fine adjustment mode", in consideration of the fact that toner in the toner layer decreases as the time in which the belt 2 rotates becomes longer.

However, at the time of the "rough adjustment mode" and the "fine adjustment mode", there is a possibility that the tension roller 31 is tilted by a great degree. Therefore, in the present exemplary embodiment, toner of a small amount compared with a toner belt serving as a supplying toner image formed in the "toner supplying operation" is moved onto the whole area of the belt 2. According to this, even if the tension roller 31 is tilted greatly, toner on the belt 2 is not likely to scatter, and thus toner can be appropriately supplied to the rubbing portion 203. In addition, toner can be moved onto the belt 2 in a shorter time than in the case of forming a toner belt.

In the exemplary embodiments described above, the "toner supplying operation" is not performed after executing the "edge profile mode" in step S6. However, exemplary embodiments of the present invention are not limited to these, and the "toner supplying operation" may be performed after executing the "edge profile mode".

To be noted, in the first exemplary embodiment, the driving of the photosensitive drums 4Y to 4K, the developing sleeves 7SY to 7SK, and the belt 2 may be stopped temporarily after executing the "toner supplying operation", and the driving of the photosensitive drums 4Y to 4K and the belt 2 may be restarted in accordance with execution of respective modes thereafter.

In addition, in the second exemplary embodiment described above, the developing sleeve 7SK may be rotated to supply toner to the rubbing portion 203 at the time of at least one of the "rough adjustment mode" of step S31, the "edge profile mode" of step S6, and the "fine adjustment mode" of step S71. Alternatively, not only the developing sleeve 7SK for black but also the developing sleeves 7SY to 7SC for the other colors may be simultaneously rotated to supply toner of plural colors to the rubbing portion 203. In this case, the amount of toner supplied to the rubbing portion 203 becomes larger than in the case of supplying only toner of a single color to the rubbing portion 203, and thus a greater effect of reducing adhering matter can be achieved.

Although the image forming apparatus 1 of an intermediate transfer system in which a composite toner image of colors is collectively transferred through secondary transfer onto a recording material P carried and conveyed by a recording material conveyance belt after toner images of respective colors are transferred through primary transfer from the photosensitive drums 4Y to 4K of respective colors onto the belt 2 has been described in the exemplary embodiments illustrated in FIG. 1, exemplary embodiments of the present invention are not limited to this example. For example, conveyance of the recording material P to the secondary transfer portion may be performed only by conveyance rollers without the recording material conveyance belt.

According to the exemplary embodiments of the present invention, a configuration capable of performing steering control is employed, and a supplying toner image is formed on a belt to supply toner to a rubbing position between the belt and a cleaning blade in at least one period of before, during, and after execution of an adjustment mode in which the positional relationship between the belt and a steering roller is adjusted. Thus, adhering matter is less likely to be formed on the belt.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-138697, filed Jul. 13, 2016, and Japanese Patent Application No. 2017-080557, filed Apr. 14, 2017, which are hereby incorporated by reference herein in their entirety.

What is claimed is:

1. An image forming apparatus comprising:

a belt formed in an endless shape, detachably provided, and configured to rotate;

an image bearing member that is rotatable and configured to bear an electrostatic latent image formed thereon;

a developing device configured to develop the electrostatic latent image formed on the image bearing member as a toner image with developer comprising toner;

a primary transfer member configured to be applied a voltage and transfer the toner image formed on the image bearing member onto the belt;

a stretching roller configured to stretch the belt and be tilted to move the belt in a width direction of the belt intersecting with a rotation direction of the belt;

a detection member configured to detect a position of an edge portion of the belt in the width direction;

a cleaning blade configured to contact the belt at a contact position to remove toner with rotation of the belt;

a secondary transfer member configured to transfer the toner image transferred onto the belt onto a recording material;

a control portion configured to control, in a period of image formation, an amount of tilting of the stretching roller on a basis of the position in the width direction detected by the detection member; and an instruction input portion through which input related to replacement of the belt is performed by an operator, wherein, in a case where the input has been performed through the instruction input portion, the control portion executes, before starting image formation for the first time after replacement of the belt, an initial mode and a toner supplying operation, wherein the initial mode is a mode of rotating the belt in a state that the cleaning blade is contacting the belt, and of tilting the stretching roller to a plurality of predetermined positions while rotating the belt, and wherein the toner supplying operation is an operation of forming a predetermined toner image, for supplying toner, on the image bearing member, of transferring the predetermined toner image to the belt, and of supplying the predetermined toner image to the contact position, at least at one of periods before and after the initial mode is executed.

2. The image forming apparatus according to claim 1, wherein the control portion performs the toner supplying operation when starting the initial mode.

3. The image forming apparatus according to claim 1, wherein the control portion performs the toner supplying operation when finishing the initial mode.

4. The image forming apparatus according to claim 1, wherein, in the initial mode, the control portion is capable of executing a first mode and executing a second mode after executing the first mode, wherein, in the first mode, the stretching roller is tilted to the plurality of predetermined positions and an amount of variation of the position in the width direction detected by the detection member is obtained for each of the plurality of predetermined positions, wherein, in the second mode, the stretching roller is fixed at a tilting position for which the amount of variation is smallest among the plurality of predetermined positions, and edge shape data used for controlling tilting of the stretching roller in image formation is obtained based on an amount detected by the detection member in a state which the stretching roller is rotating, and wherein the control portion performs the toner supplying operation at least before executing the first mode.

5. The image forming apparatus according to claim 4, wherein the control portion performs the toner supplying operation after executing the first mode and before executing the second mode.

6. The image forming apparatus according to claim 4, wherein, in the initial mode, the control portion is capable of executing a third mode after executing the second mode, wherein, in the third mode, the stretching roller is tilted on a basis of the position in the width direction detected by the detection member, and a tilting position for which a difference between the position in the width direction and the edge shape data is the smallest is set as a standard position at which tilting of the stretching roller is started in image formation, and wherein the control portion finishes the initial mode after executing the third mode.

7. The image forming apparatus according to claim 6, wherein the toner supplying operation is not performed in the first mode.

8. The image forming apparatus according to claim 6, further comprising:

a first power source configured to apply a primary transfer bias to the primary transfer member; and a second power source configured to apply a secondary transfer bias to the secondary transfer member, wherein the control portion controls the first power source and the second power source such that the primary transfer bias and the secondary transfer bias are not applied in the first mode.

9. The image forming apparatus according to claim 8, further comprising:

a developer bearing member disposed so as to oppose the image bearing member and capable of rotating while bearing the developer;

a charging voltage application portion configured to apply a charging voltage to the image bearing member; and a developing voltage application portion configured to apply a developing voltage to the developer bearing member, wherein, when executing the first mode or the third mode, the control portion rotates the image bearing member and the developer bearing member, and causes the charging voltage application portion and the developing voltage application portion to apply the charging voltage and the developing voltage such that a polarity of a potential of the image bearing member relative to a potential of the developer bearing member is the same as a charging polarity of the toner.

10. The image forming apparatus according to claim 6, wherein the toner supplying operation is not performed in the second mode.

11. The image forming apparatus according to claim 6, wherein the toner supplying operation is not performed in the third mode.

12. The image forming apparatus according to claim 6, further comprising:

a first power source configured to apply a primary transfer bias to the primary transfer member; and a second power source configured to apply a secondary transfer bias to the secondary transfer member, wherein the control portion controls the first power source and the second power source such that the primary transfer bias and the secondary transfer bias are not applied in the second mode.

13. The image forming apparatus according to claim 6, further comprising:

a first power source configured to apply a primary transfer bias to the primary transfer member; and a second power source configured to apply a secondary transfer bias to the secondary transfer member, wherein the control portion controls the first power source and the second power source such that the primary transfer bias and the secondary transfer bias are not applied in the third mode.

14. The image forming apparatus according to claim 6, wherein the developing device is stopped in the first mode.

15. The image forming apparatus according to claim 6, wherein the developing device is stopped in the second mode.

16. The image forming apparatus according to claim 6, wherein the developing device is stopped in the third mode.

17. The image forming apparatus according to claim 1, wherein a surface of the belt is coated with a releasing agent.

18. The image forming apparatus according to claim 1, wherein a surface of the belt includes fine structures including recesses and projections formed along the rotation direction of the belt.

19. The image forming apparatus according to claim 1, further comprising:

an exposing portion configured to expose the image bearing member with light to form the electrostatic latent image on the image bearing member, wherein, in the toner supplying operation, the exposing portion exposes the image bearing member with light and thereby forms the electrostatic latent image for forming the predetermined toner image.

20. The image forming apparatus according to claim 1, wherein the predetermined toner image has a belt-shaped portion.

21. The image forming apparatus according to claim 1, wherein the predetermined toner image is a solid toner image.

22. The image forming apparatus according to claim 1, wherein the belt comprises a surface layer, which is formed of acrylic resin containing fluorine resin added thereto, on outer peripheral surface.

23. The image forming apparatus according to claim 1, wherein the absolute value of a surface potential of the image bearing member, when the predetermined toner image is formed on the image bearing member, is smaller than the absolute value of a developing voltage which is applied to the developing device when the developing device develops the predetermined toner image, and wherein the surface potential and the developing voltage are the same as a charging polarity of the toner.

24. The image forming apparatus according to claim 1, wherein the belt comprises a roughened surface.

25. An image forming apparatus comprising:

a belt formed in an endless shape, detachably provided, and configured to rotate;

an image bearing member that is rotatable and configured to bear an electrostatic latent image formed thereon;

a developing device configured to develop the electrostatic latent image formed on the image bearing member as a toner image with developer comprising toner;

a primary transfer member configured to transfer the toner image formed on the image bearing member onto the belt;

a stretching roller configured to stretch the belt and be tilted to move the belt in a width direction of the belt intersecting with a rotation direction of the belt;

a detection member configured to detect a position of an edge portion of the belt in the width direction;

a cleaning blade configured to contact the belt at a contact position and remove a deposit on the belt with rotation of the belt;

a secondary transfer member configured to transfer the toner image transferred onto the belt onto a recording material;

a control portion configured to control, in a period of image formation, an amount of tilting of the stretching roller on a basis of the position in the width direction detected by the detection member; and a replacement detection portion configured to detect information related to replacement of the belt, wherein, in a case where the information related to replacement of the belt has been detected by the replacement detection portion, the control portion executes, before starting image formation for the first time after replacement of the belt, an initial mode and a toner supplying operation, wherein the initial mode is a mode of rotating the belt in a state that the cleaning blade is contacting the belt, and of tilting the stretching roller to a plurality of predetermined positions while rotating the belt, and wherein the toner supplying operation is an operation of forming a predetermined toner image, for supplying toner, on the image bearing member, of transferring the predetermined toner image to the belt, and of supplying the predetermined toner image to the contact position, at least at one of periods before and after the initial mode is executed.

* * * * *